US006409307B1

(12) United States Patent
Akhavain et al.

(10) Patent No.: US 6,409,307 B1
(45) Date of Patent: Jun. 25, 2002

(54) COPLANAR MOUNTING OF PRINTHEAD DIES FOR WIDE-ARRAY INKJET PRINTHEAD ASSEMBLY

(75) Inventors: Mohammad Akhavain; Robert-Scott Melendrino Lopez, both of Escondido; Dale Dean Timm, Jr., Solana Beach; Janis Horvath, San Diego; Noah Carl Lassar, San Diego; David McElfresh, San Diego; Brian J. Keefe, La Jolla; Joseph E. Scheffelin, Poway, all of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/783,676

(22) Filed: Feb. 14, 2001

(51) Int. Cl.[7] ..... B41J 2/155
(52) U.S. Cl. ..... 347/42; 347/13; 347/49
(58) Field of Search ..... 347/49, 12, 42, 347/13, 40, 50, 59, 63; 156/299

(56) References Cited

U.S. PATENT DOCUMENTS 4,999,077 A * 3/1991 Drake et al. ..... 156/299
5,016,023 A 5/1991 Chan et al. ..... 347/42
5,057,854 A 10/1991 Pond et al. ..... 347/42
5,079,189 A 1/1992 Drake et al. ..... 438/21
5,098,503 A 3/1992 Drake ..... 156/299
5,160,945 A 11/1992 Drake ..... 347/42
5,510,273 A * 4/1996 Quinn ..... 437/3
5,696,544 A 12/1997 Komuro ..... 347/50
5,719,605 A 2/1998 Anderson et al. ..... 347/59
5,742,305 A 4/1998 Hackleman ..... 347/12
5,753,959 A * 5/1998 Quinn et al. ..... 257/443
5,755,024 A 5/1998 Drake et al. ..... 29/611
5,946,012 A 8/1999 Courian et al. ..... 347/63
6,246,429 B1 * 6/2001 Ono ..... 347/238
6,254,215 B1 * 7/2001 Hiroki et al. ..... 347/210

* cited by examiner

*Primary Examiner*—Lamson D. Nguyen

(57) ABSTRACT

An inkjet printhead assembly includes a substrate having a non-planar surface and a plurality of adhesive quantities each disposed on the non-planar surface of the substrate. As such, a plurality of printhead dies are each adhered to the non-planar surface of the substrate by one of the adhesive quantities. A thickness of at least one of the adhesive quantities varies from the thickness of another of the adhesive quantities such that the thickness of the adhesive quantities compensates for the non-planar surface of the substrate. Thus, the adhesive quantities support the printhead dies and establish a substantially coplanar relationship among the printhead dies.

35 Claims, 11 Drawing Sheets

COPLANAR MOUNTING OF PRINTHEAD DIES FOR WIDE-ARRAY INKJET PRINTHEAD ASSEMBLY

THE FIELD OF THE INVENTION

The present invention relates generally to inkjet printheads, and more particularly to a wide-array inkjet printhead assembly.

BACKGROUND OF THE INVENTION

A conventional inkjet printing system includes a printhead and an ink supply which supplies liquid ink to the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

In one arrangement, commonly referred to as a wide-array inkjet printing system, a plurality of individual printheads, also referred to as printhead dies, are mounted on a single substrate. As such, a number of nozzles and, therefore, an overall number of ink drops which can be ejected per second is increased. Since the overall number of drops which can be ejected per second is increased, printing speed can be increased with the wide-array inkjet printing system.

Mounting a plurality of printhead dies on a single substrate, however, requires precise alignment between the printhead dies. FIGS. 1A and 1B illustrate mounting of a plurality of printhead dies 90 on a substrate 92 using conventional mounting methods. In FIG. 1A, for example, the printhead dies are mounted on the substrate with an adhesive 94. As such, the printhead dies are pushed down to achieve a predefined force which results in a predetermined gap between the substrate and the printhead dies. In FIG. 1B, for example, the printhead dies are mounted on the substrate with the adhesive and standoffs 96 which are interposed between the printhead dies and the substrate. As such, the printhead dies are pushed down until they contact the standoffs.

With the conventional mounting methods, however, the printhead dies follow the profile of the substrate. Thus, a variation in planarity of the substrate results in a variation of planarity among the printhead dies and, therefore, misalignment between the printhead dies. The printhead dies, therefore, are not coplanar. Unfortunately, misalignment between the printhead dies can adversely affect performance of the inkjet printing system. A variation of planarity among the printhead dies, for example, can result in ink drop trajectory errors as well as pen-to-paper spacing problems which degrade print quality.

Accordingly, a need exists for precisely mounting and aligning a plurality of printhead dies on a single substrate of a wide-array inkjet printhead assembly such that misalignment between the printhead dies is avoided and coplanarity of the printhead dies is achieved.

SUMMARY OF THE INVENTION

One aspect of the present invention provides an inkjet printhead assembly. The inkjet printhead assembly includes a substrate having a non-planar surface, a plurality of adhesive quantities each disposed on the non-planar surface of the substrate, and a plurality of printhead dies each adhered to the non-planar surface of the substrate by one of the adhesive quantities. As such, each of the adhesives quantities have a thickness such that the thickness of at least one of the adhesive quantities varies from the thickness of another of the adhesive quantities to compensate for the non-planar surface of the substrate. Thus, the adhesive quantities support the printhead dies and establish a substantially coplanar relationship among the printhead dies.

BRIEF DESCRIPTION OF THE DRAWINGS

FIG. 6A is a schematic perspective view illustrating one embodiment of positioning of a printhead die on a die pre-alignment stage according to the present invention;

FIG. 6B is a schematic perspective view illustrating one embodiment of alignment of a plurality of printhead dies on the die pre-alignment stage of FIG. 6A;

FIG. 6C is a schematic perspective view illustrating one embodiment of positioning of a substrate on a substrate alignment stage according to the present invention;

FIG. 6D is a schematic perspective view illustrating one embodiment of adhesive dispensed on the substrate of FIG. 6C;

FIG. 6E is a schematic perspective view illustrating one embodiment of transfer of the printhead dies of FIG. 6B to the substrate of FIG. 6D;

FIG. 6F is a schematic perspective view illustrating one embodiment of positioning the printhead dies on the substrate following transfer of the printhead dies to the substrate in FIG. 6E;

FIG. 6G is a schematic cross-sectional view illustrating one embodiment of an enlarged portion of FIG. 6F;

FIG. 6H is a schematic perspective view illustrating one embodiment of curing of the adhesive after positioning of the printhead dies on the substrate in FIG. 6F;

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 2:
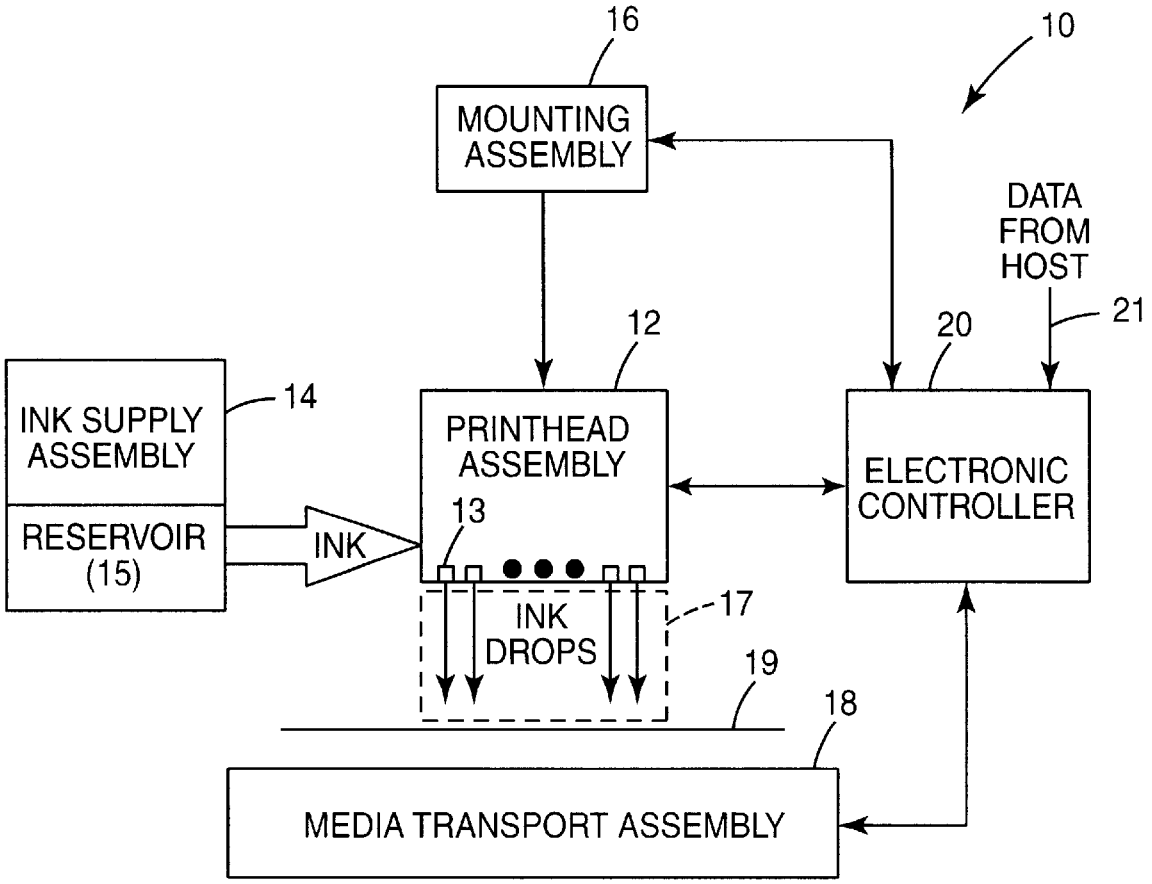
FIG. 2 is a block diagram illustrating one embodiment of an inkjet printing system according to the present invention.

FIG. 2 illustrates one embodiment of an inkjet printing system 10 according to the present invention. Inkjet printing system 10 includes an inkjet printhead assembly 12, an ink supply assembly 14, a mounting assembly 16, a media transport assembly 18, and an electronic controller 20. Inkjet printhead assembly 12 is formed according to an embodiment of the present invention, and includes one or more printheads which eject drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller 20 communicates with inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is incorporated in inkjet printhead assembly 12. In another embodiment, logic and drive circuitry is located off inkjet printhead assembly 12.

Figure 3:
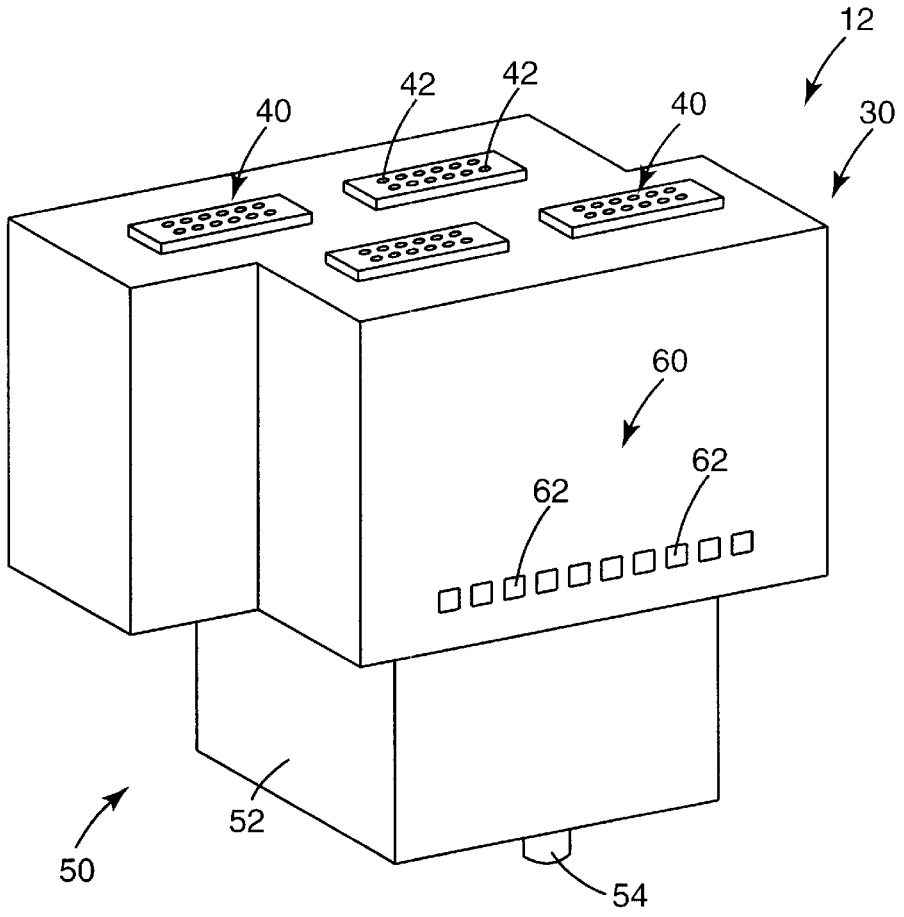
FIG. 3 is a top perspective view of one embodiment of an inkjet printhead assembly including a plurality of printhead dies according to the present invention.

FIG. 3 illustrates one embodiment of a portion of inkjet printhead assembly 12. Inkjet printhead assembly 12 is a wide-array or multi-head printhead assembly and includes a carrier 30, a plurality of printhead dies 40, an ink delivery system 50, and an electronic interface system 60. Carrier 30 serves to carry printhead dies 40 and provide electrical and fluidic communication between printhead dies 40, ink supply assembly 14, and electronic controller 20.

Printhead dies 40 are mounted on a face of carrier 30 and aligned in one or more rows. In one embodiment, printhead dies 40 are spaced apart and staggered such that printhead dies 40 in one row overlap at least one printhead die 40 in another row. Thus, inkjet printhead assembly 12 may span a nominal page width or a width shorter or longer than nominal page width. In one embodiment, a plurality of inkjet printhead assemblies 12 are mounted in an end-to-end manner. Carrier 30, therefore, has a staggered or stair-step profile. Thus, at least one printhead die 40 of one inkjet printhead assembly 12 overlaps at least one printhead die 40 of an adjacent inkjet printhead assembly 12. While four printhead dies 40 are illustrated as being mounted on carrier 30, the number of printhead dies 40 mounted on carrier 30 may vary.

Ink delivery system 50 fluidically couples ink supply assembly 14 with printhead dies 40. In one embodiment, ink delivery system 50 includes a manifold 52 and a port 54. Manifold 52 is mounted on carrier 30 and distributes ink through carrier 30 via ink passages 56 (FIG. 6C) to each printhead die 40. Port 54 communicates with manifold 52 and provides an inlet for ink supplied by ink supply assembly 14.

Electronic interface system 60 electrically couples electronic controller 20 with printhead dies 40. In one embodiment, electronic interface system 60 includes a plurality of input/output (I/O) contact pads 62 which contact corresponding electrical nodes (not shown) electrically coupled to electronic controller 20. As such, I/O contact pads 62 communicate electrical signals between electronic controller 20 and inkjet printhead assembly 12. It is understood that I/O contact pads 62 may be replaced with other electrical connectors such as I/O pins protruding from carrier 30 which engage corresponding I/O receptacles electrically coupled to electronic controller 20.

Figure 4:
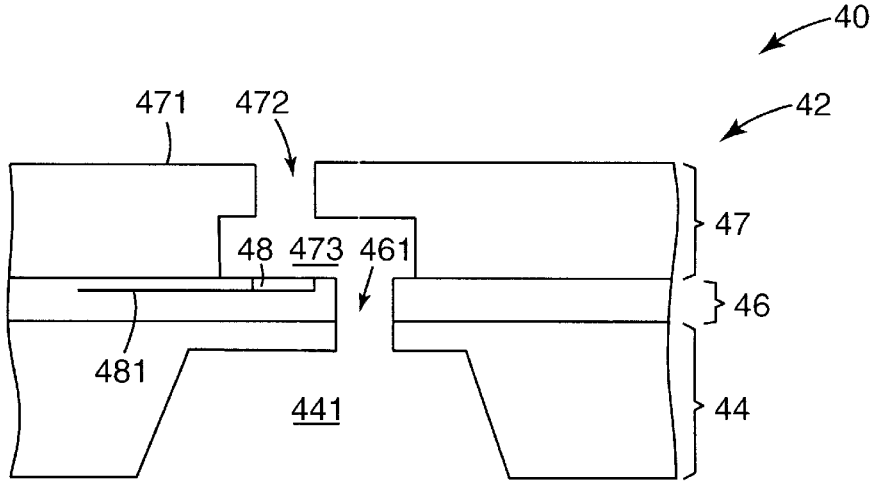
FIG. 4 is a schematic cross-sectional view illustrating one embodiment of portions of a printhead die according to the present invention.

As illustrated in FIGS. 1 and 4, each printhead die 40 includes an array of printing or drop ejecting elements 42. Printing elements 42 are formed on a substrate 44 which has an ink feed slot 441 formed therein. As such, ink feed slot 441 provides a supply of liquid ink to printing elements 42. Each printing element 42 includes a thin-film structure 46, an orifice layer 47, and a firing resistor 48. Thin-film structure 46 has an ink feed channel 461 formed therein which communicates with ink feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and ink feed channel 461 of thin-film structure 46. Firing resistor 48 is positioned within nozzle chamber 473 and includes leads 481 which electrically couple firing resistor 48 to a drive signal and ground.

During printing, ink flows from ink feed slot 441 to nozzle chamber 473 via ink feed channel 461. Nozzle opening 472 is operatively associated with firing resistor 48 such that droplets of ink within nozzle chamber 473 are ejected through nozzle opening 472 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

Figure 5:
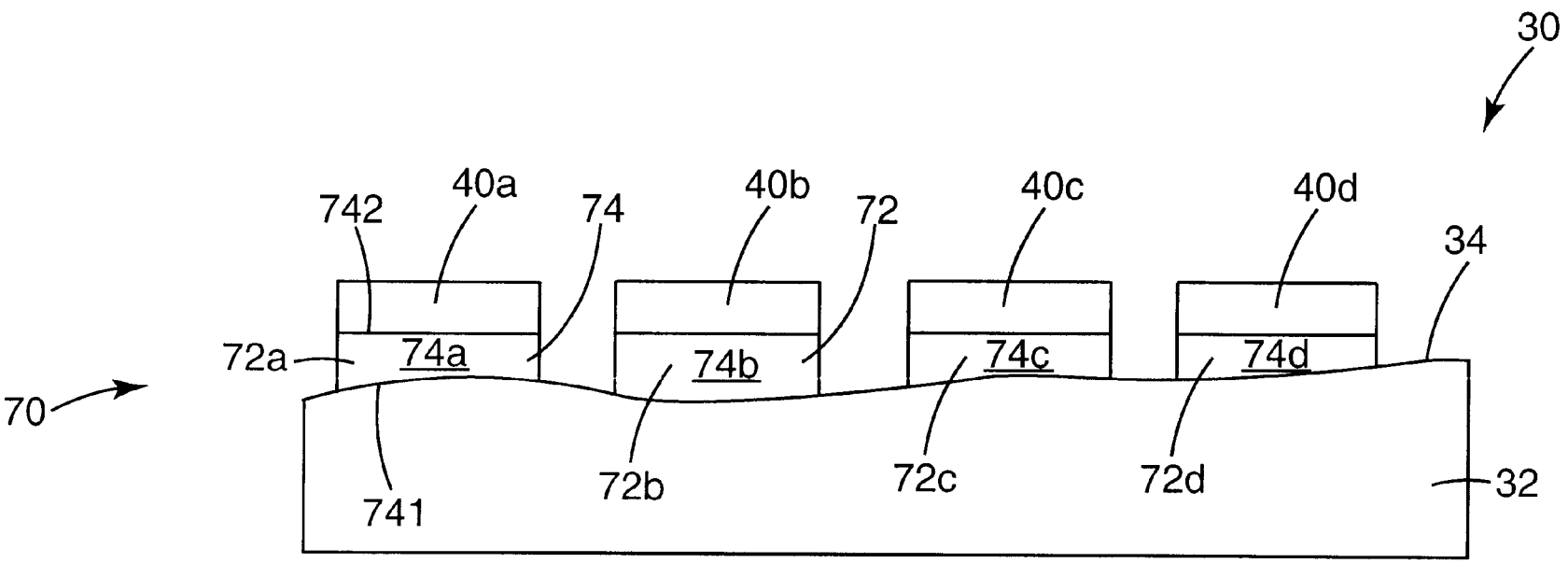
FIG. 5 is a schematic cross-sectional view illustrating one embodiment of a plurality of printhead dies each mounted on a substrate according to the present invention.

As illustrated in FIG. 5, carrier 30 includes a substrate 32 on which printhead dies 40 are mounted. Substrate 32 includes a surface 34 which is non-planar and on which printhead dies 40 are mounted. As such, substrate 32 provides mechanical support for printhead dies 40 and surface 34 constitutes a non-planar surface of substrate 32. In one embodiment, substrate 32 is formed of a ceramic, silicon, or suitable non-metallic material.

Non-planarity of surface 34 is illustrated as warpage and/or bowing of substrate 32. Non-planarity of surface 34 may result, for example, from manufacture of carrier 30 and/or other inherent characteristics of substrate 32. It is understood that the extent of non-planarity of surface 34 illustrated in FIG. 5 has been exaggerated for clarity of the invention.

Printhead dies 40 are secured or affixed to substrate 32 with an adhesive 70. In one embodiment, adhesive 70 includes a plurality of individual or separate adhesive quantities 72*a*, 72*b*, 72*c*, 72*d*. As such, adhesive quantities 72*a*, 72*b*, 72*c*, 72*d* secure respective printhead dies 40*a*, 40*b*, 40*c*, 40*d* to substrate 32. Accordingly, adhesive quantities 72*a*, 72*b*, 72*c*, 72*d* form respective adhesive layers 74*a*, 74*b*, 74*c*, 74*d* between respective printhead dies 40*a*, 40*b*, 40*c*, 40*d* and surface 34 of substrate 32. For clarity, adhesive quantities 72*a*, 72*b*, 72*c*, 72*d*, adhesive layers 74*a*, 74*b*, 74*c*, 74*d*, and printhead dies 40*a*, 40*b*, 40*c*, 40*d* are referred to hereinafter as adhesive quantities 72, adhesive layers 74, and printhead dies 40, respectively.

Adhesive layers 74 each have a first side 741 and a second side 742 opposite first side 741. In one embodiment, first side 741 contacts and conforms to non-planar surface 34 of substrate 32 and second side 742 contacts one printhead die 40. As such, second side 742 of adhesive layers 74 is substantially planar while first side 741 of one or more adhesive layers 74 is not substantially planar. Thus, a thickness of one or more adhesive layers 74 varies. In addition, a thickness of one adhesive quantity 72 and, therefore, one adhesive layer 74 varies from a thickness of another adhesive quantity 72 and, therefore, another adhesive layer 74. Accordingly, adhesive quantities 72 and, therefore, adhesive layers 74 support printhead dies 40 and compensate for the non-planarity of surface 34 when printhead dies 40 are mounted on substrate 32. Coplanar mounting of printhead dies 40, therefore, is achieved.

In one embodiment, adhesive 70 includes a surface mount adhesive which is compatible with ink. As such, adhesive 70 may include a heat cure adhesive and/or an ambient cure adhesive. In addition, adhesive 70 may include an ultraviolet light curable adhesive. An example of adhesive 70 includes Emerson & Cuming's 3032 thermal cure adhesive.

FIGS. 6A–6H illustrate one embodiment of a method of mounting printhead dies 40 on substrate 32. While the following description only refers to mounting of inkjet printhead dies 40 on substrate 32, it is understood that the present invention is also applicable to mounting of other multiple chips and/or die modules such as silicon wafers and/or integrated circuits on substrate 32.

Figure 6A:
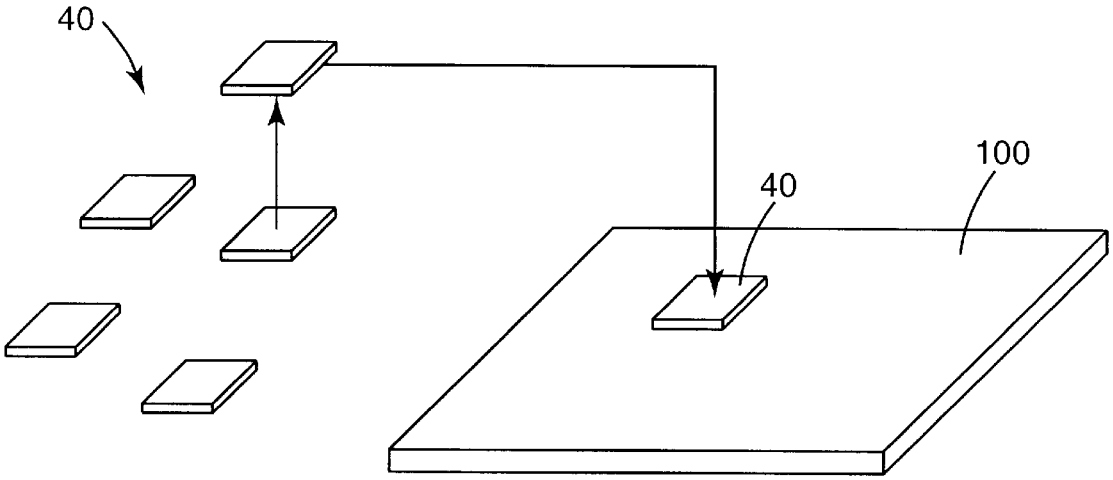
FIGS. 6A–6H illustrate one embodiment of a method of mounting a plurality of printhead dies on a substrate according to the present invention.
Figure 6B:
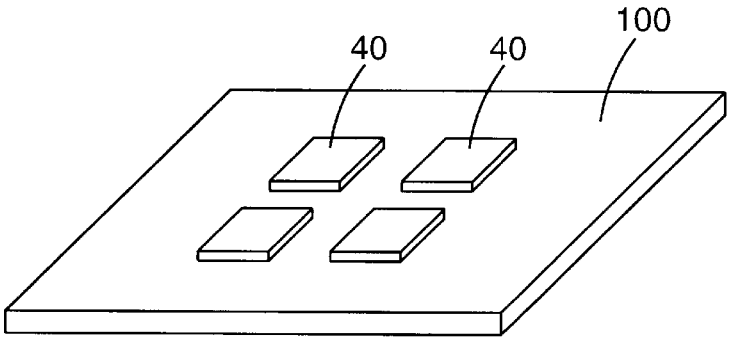

As illustrated in FIGS. 6A and 6B, printhead dies 40 are positioned on a die pre-alignment stage 100. Preferably, as illustrated in FIG. 6A, printhead dies 40 are each moved individually from a source or supply of printhead dies 40 to die pre-alignment stage 100. In addition, as illustrated in FIG. 6B, printhead dies 40 are positioned on die pre-alignment stage 100 corresponding to a desired arrangement and/or alignment of printhead dies 40 on substrate 32. As such, printhead dies 40 are aligned relative to each other on die pre-alignment stage 100 such that coplanarity among printhead dies 40 is established. While printhead dies 40 are illustrated in FIG. 6B as being arranged in two rows and two columns, it is understood that printhead dies 40 may be arranged in other configurations including staggered rows as illustrated in FIG. 3.

Figure 6C:
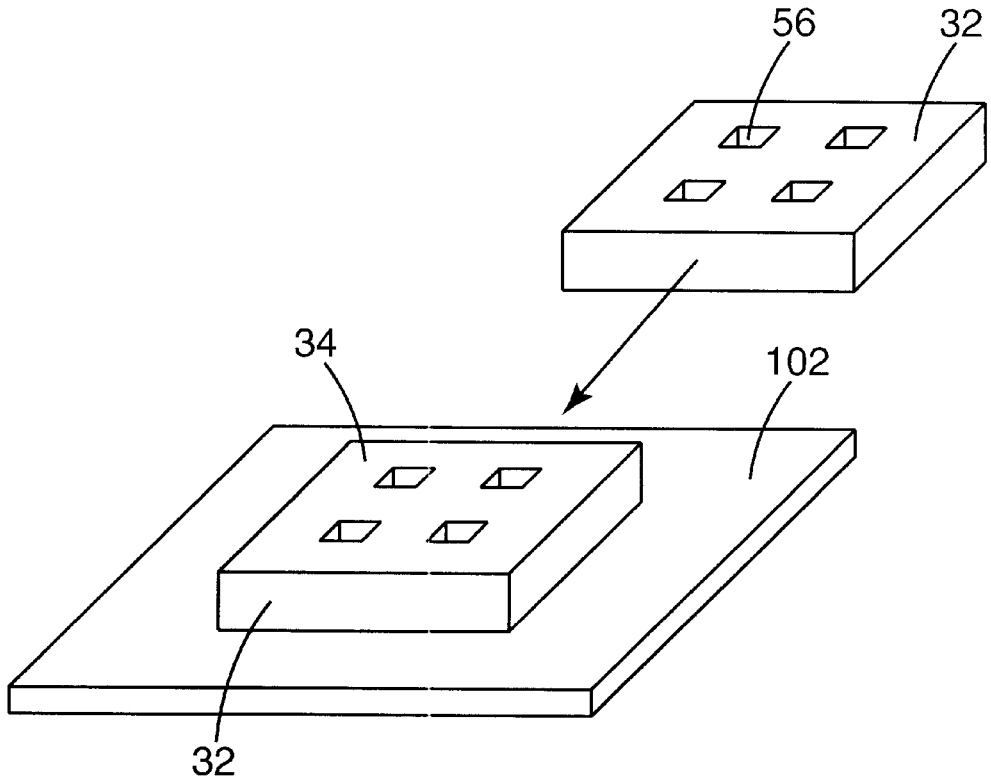

As illustrated in FIG. 6C, substrate 32 is positioned on a substrate alignment stage 102. As such, substrate alignment stage 102 supports substrate 32 during mounting of printhead dies 40. Preferably, substrate 32 is positioned such that surface 34 is exposed and directed upward. As such, ink passages 56 are exposed.

Figure 6D:
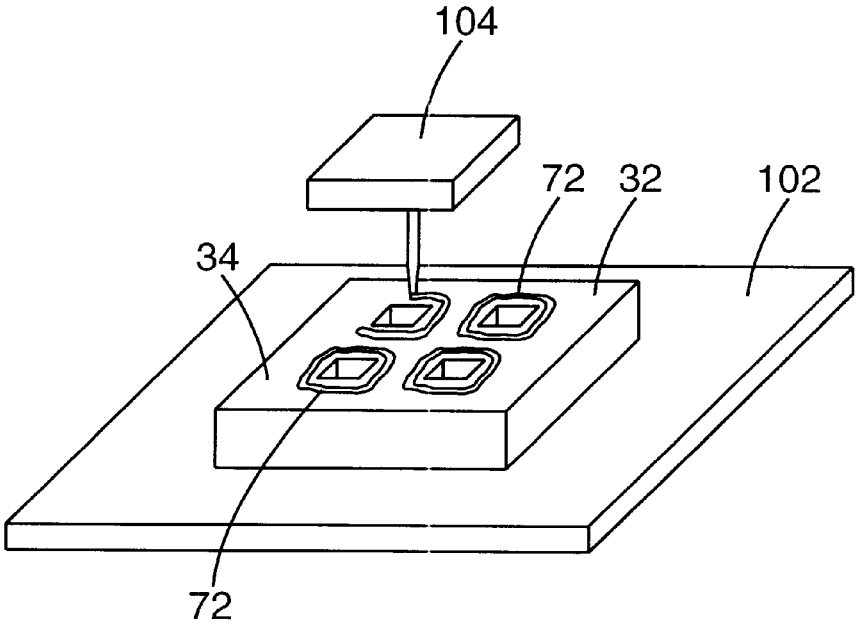

Next, as illustrated in FIG. 6D, adhesive 70 in the form of adhesive quantities 72 is dispensed on substrate 32. Adhesive quantities 72 are dispensed, for example, from a dispensing unit 104 containing adhesive 70. In one embodiment, adhesive quantities 72 are dispensed in the form of closed loop or continuous beads of adhesive which surround a perimeter of the respective ink passages 56. As such, adhesive quantities 72 form ink passages between substrate 32 and printhead dies 40 when printhead dies 40 are adhered to substrate 32 with adhesive 70. Preferably, a thickness of adhesive layers 74 prior to mounting of printhead dies 40 on substrate 32 is equal to or greater than a maximum deviation of surface 34 plus a minimum thickness of adhesive layer 74 required to adhere printhead dies 40 to substrate 32.

Figure 6E:
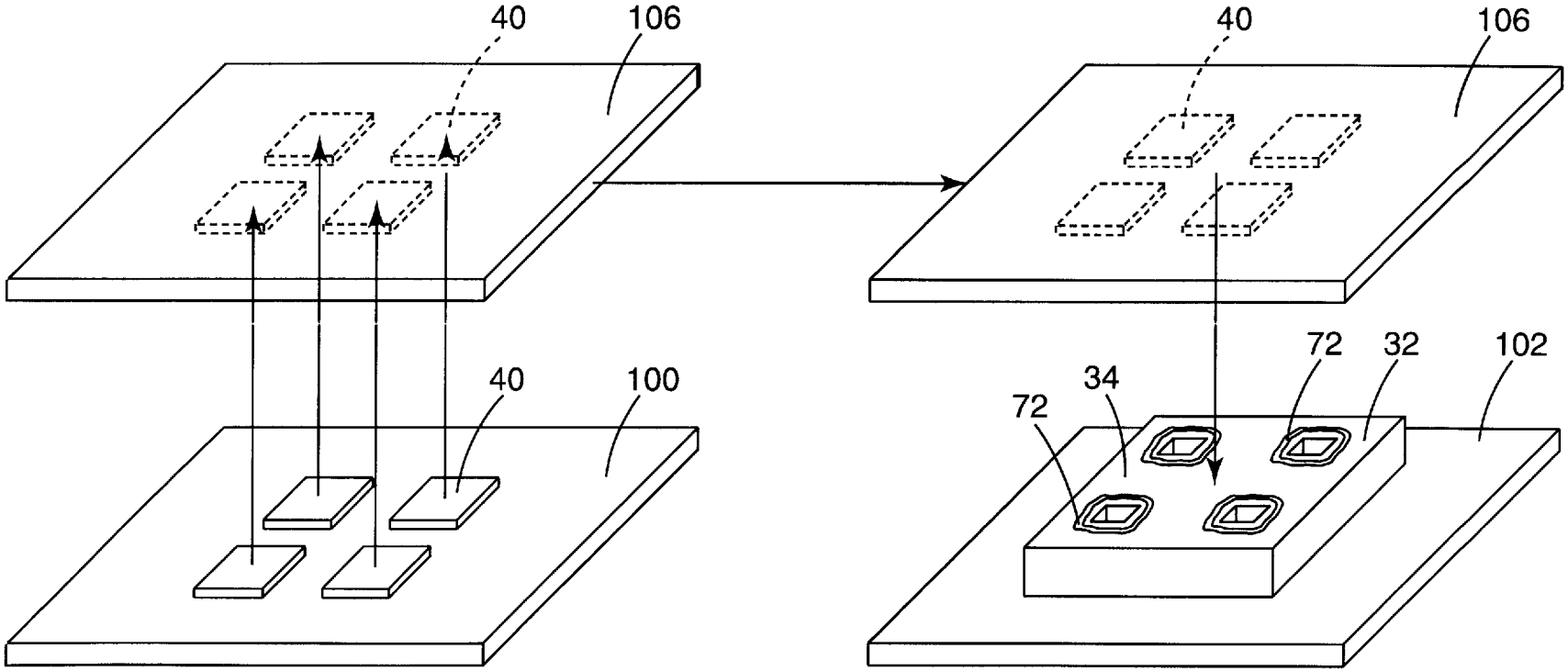

Next, as illustrated in FIG. 6E, a transfer arm 106 picks up printhead dies 40 from die pre-alignment stage 100 and moves printhead dies 40 to above substrate 32 as positioned on substrate alignment stage 102. Accordingly, printhead dies 40 are held on a bottom side of transfer arm 106. While FIG. 6E illustrates transfer of all printhead dies 40 at one time, it is also within the scope of the present invention for transfer arm 106 to pick up and move printhead dies 40 one at a time.

While removing printhead dies 40 from die pre-alignment stage 100, transfer arm 106 maintains the relative positioning and alignment of printhead dies 40. In addition, while moving printhead dies 40 to above substrate 32, transfer arm 106 aligns printhead dies 40 with substrate 32. Transfer arm 106 aligns printhead dies 40 with, for example, adhesive quantities 72 and/or ink passages 56.

In one embodiment, to align printhead dies 40 with substrate 32, transfer arm 106 utilizes an indexing system which includes a mechanical, electrical, and/or optical sensing system. Such an indexing system may, for example, register with or sense a datum, target, fiducial, or feature of substrate 32 and/or substrate alignment stage 102. Thus, with printhead dies 40 aligned with substrate 32, transfer arm 106 lowers printhead dies 40 toward substrate 32.

Figure 6F:
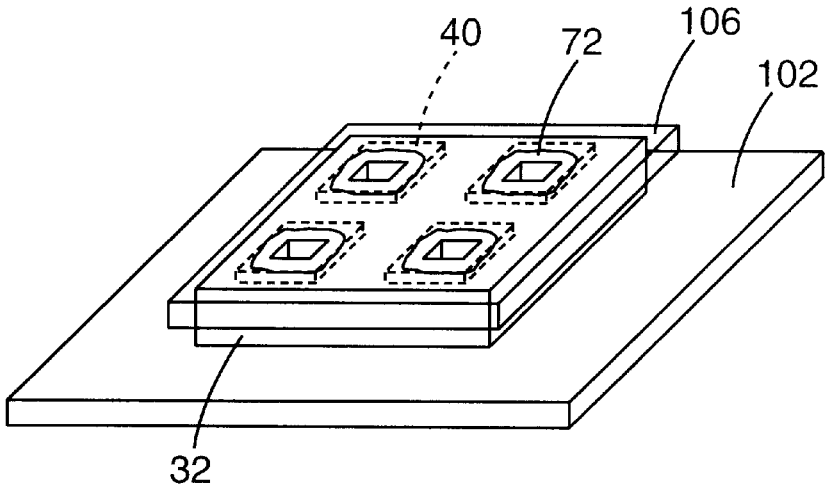
Figure 6G:
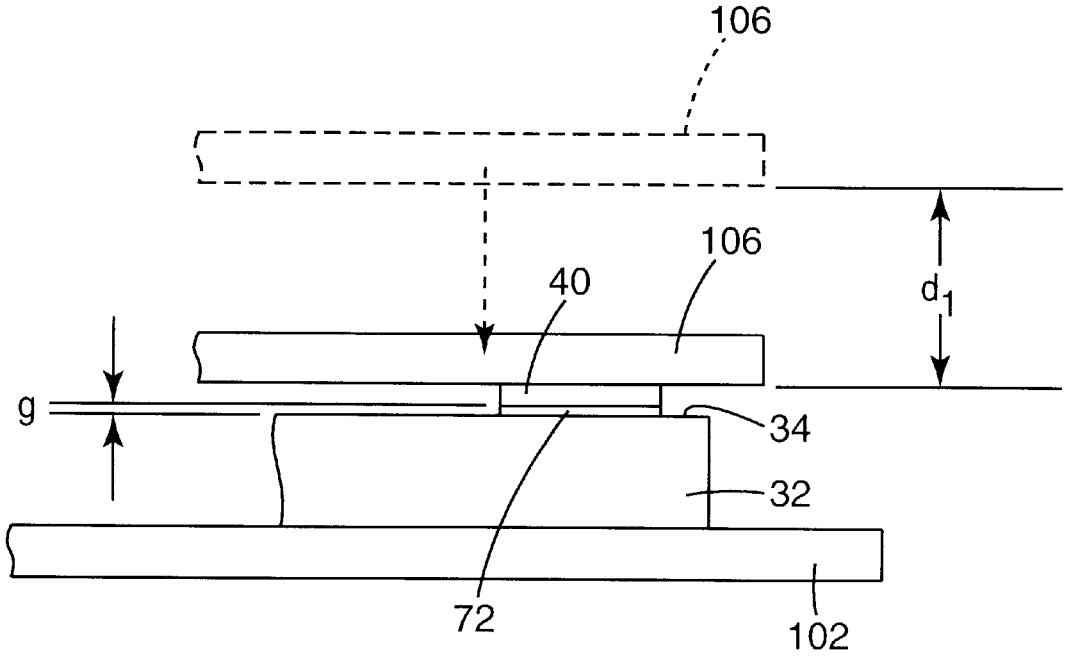

As illustrated in FIGS. 6F and 6G, transfer arm 106 is lowered toward substrate alignment stage 102 such that printhead dies 40 are moved toward substrate 32 and, more specifically, surface 34. Thus, printhead dies 40 are all moved together. Coplanarity among printhead dies 40, therefore, is maintained. Transfer arm 106 is lowered to a position such that printhead dies 40 contact adhesive quantities 72. As such, transfer arm 106 holds printhead dies 40 in contact with adhesive 70.

In one embodiment, as illustrated in FIG. 6G, transfer arm 106 is lowered a predetermined distance di. As such, a predefined gap g is created between printhead dies 40 and substrate 32. Thus, adhesive layers 74 are formed between printhead dies 40 and surface 34 of substrate 32. Because adhesive layers 74 can vary relative to each other, coplanar mounting of printhead dies 40 is achieved. While transfer arm 106 is illustrated as being lowered toward substrate alignment stage 102, it is also within the scope of the present invention for substrate alignment stage 102 to be raised toward transfer arm 106 or for substrate alignment stage 102 and transfer arm 106 to be moved toward each other.

Figure 6H:
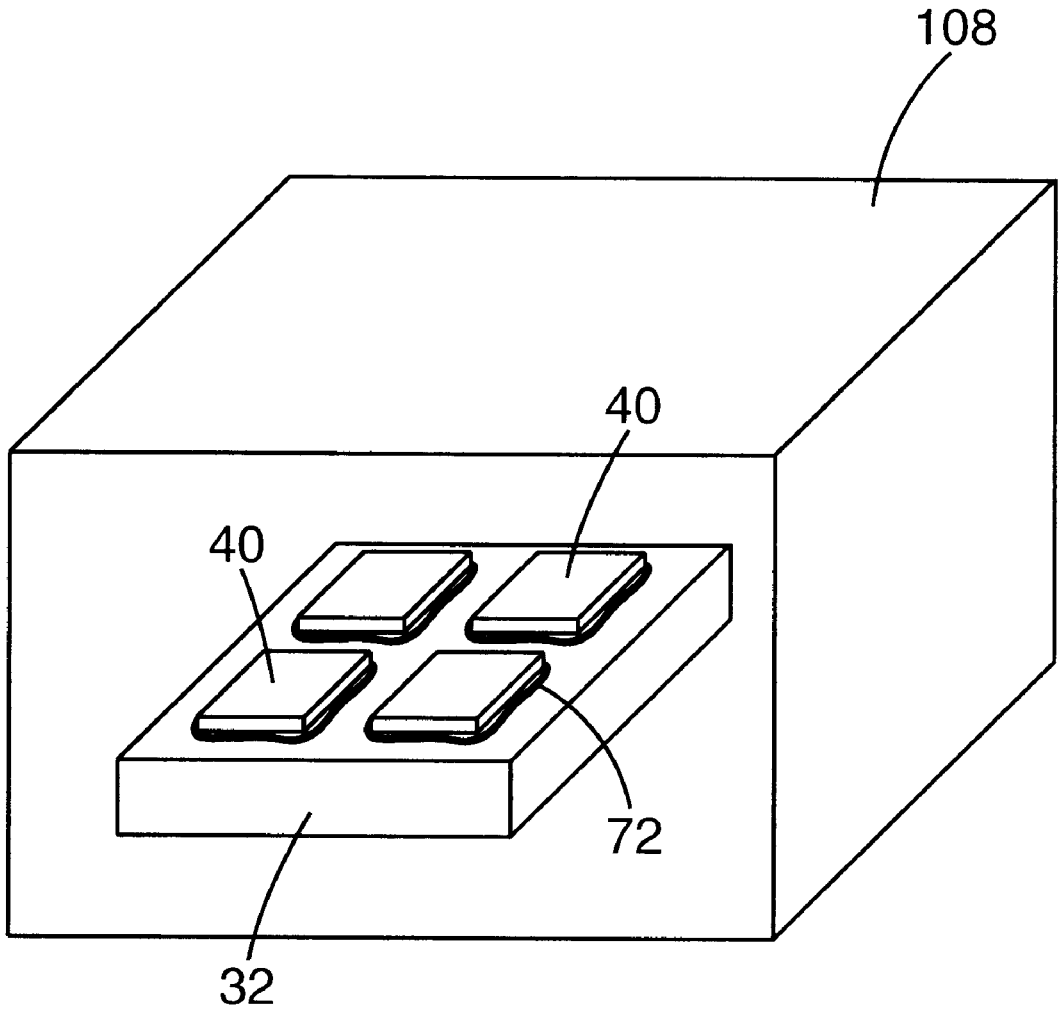

Next, as illustrated in FIG. 6H, substrate 32 with printhead dies 40 mounted thereon is transferred to a curing station 108. In one embodiment, adhesive 70 is an ultraviolet light curing adhesive. As such, curing station 108 includes an ultraviolet light station which generates ultraviolet light for curing adhesive 70. In another embodiment, adhesive 70 is a heat cured or thermal adhesive. As such, curing station 108 includes an oven which generates heat for curing adhesive 70. In addition, adhesive 70 may be cured at room or ambient temperature. While curing of adhesive 70 is illustrated removed from transfer arm 106 and substrate alignment stage 102, it is also within the scope of the present invention for adhesive 70 to be cured while transfer arm 106 holds printhead dies 40 in contact with adhesive 70 and/or while substrate alignment stage 102 supports substrate 32.

Figure 7:
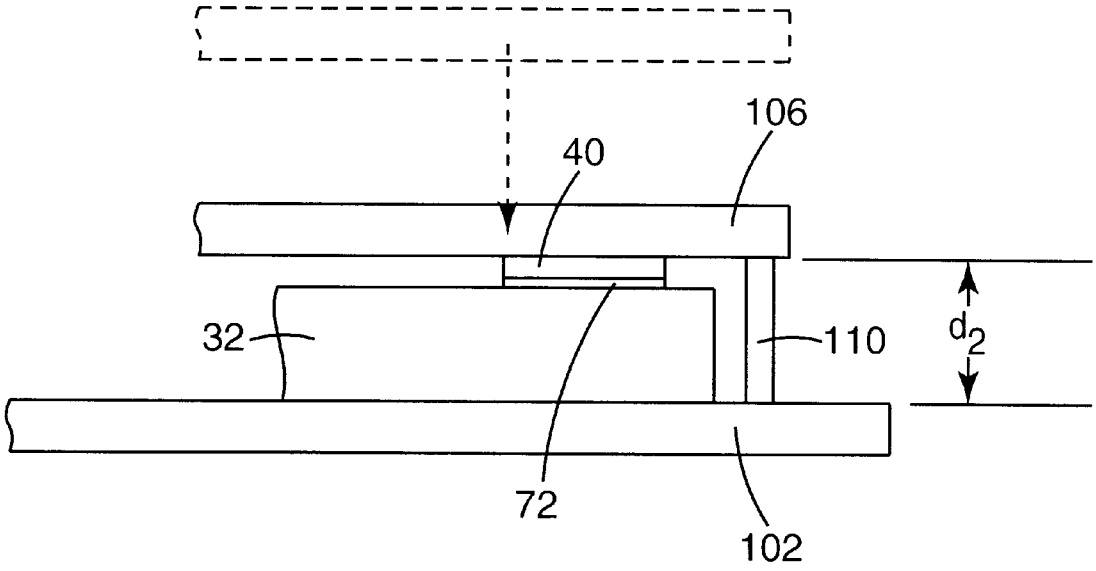
FIG. 7 is a schematic cross-sectional view similar to FIG. 6G illustrating another embodiment of positioning the printhead dies on the substrate in FIG. 6F.

In one embodiment, as illustrated in FIG. 7, transfer arm 106 is lowered so as to be spaced a predetermined distance $d_2$ from substrate alignment stage 102. To establish predetermined distance $d_2$, a standoff 110 is positioned between transfer arm 106 and substrate alignment stage 102. As such, standoff 110 limits movement of transfer arm 106 toward substrate alignment stage 102. Thus, printhead dies 40 are set at a predetermined height. While only one standoff 110 is illustrated, it is within the scope of the present invention for one or more standoffs 110 to be positioned between transfer arm 106 and substrate alignment stage 102. Multiple standoffs 110 may be positioned, for example, at corners of substrate 32.

Figure 8:
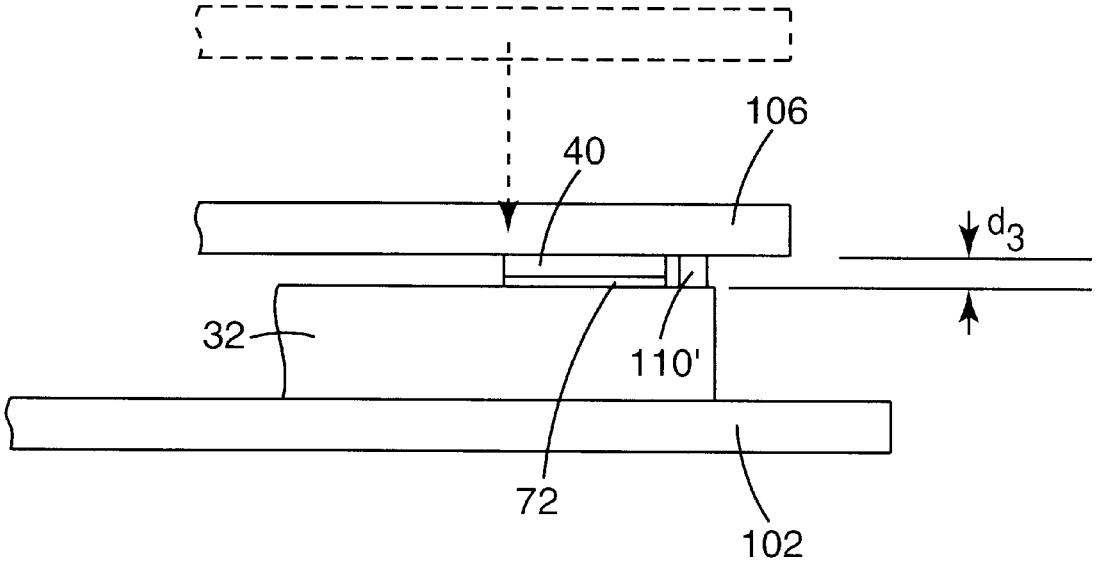
FIG. 8 is a schematic cross-sectional view similar to FIG. 7 illustrating another embodiment of positioning the printhead dies on the substrate in FIG. 6F.

In one embodiment, as illustrated in FIG. 8, transfer arm 106 is lowered so as to be spaced a predetermined distance $d_3$ from substrate 32. To establish predetermined distance $d_3$, a standoff 110' similar to standoff 110 is positioned between transfer arm 106 and substrate 32. As such, standoff 110' limits movement of transfer arm 106 toward substrate 32. Thus, printhead dies 40 are set at a predetermined height.

Figure 9:
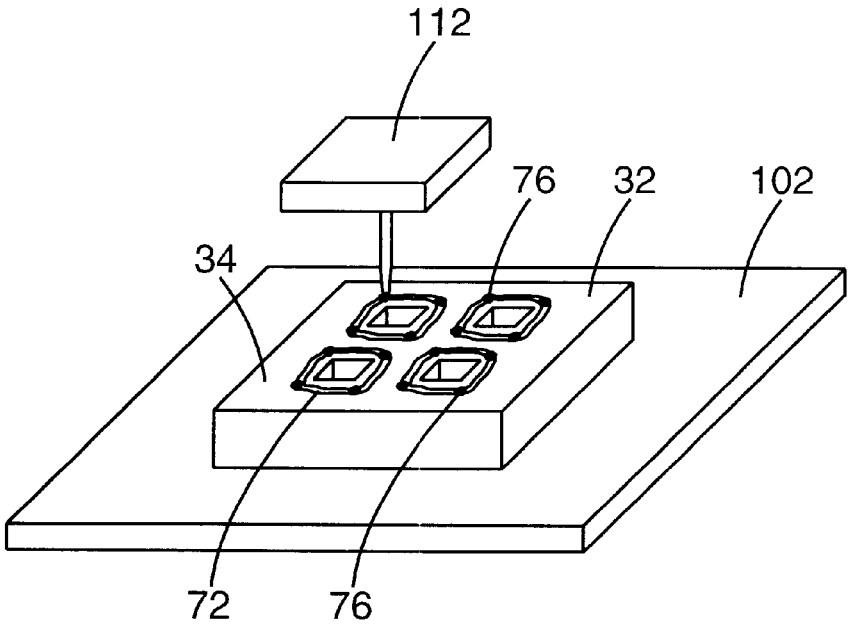
FIG. 9 is a schematic perspective view similar to FIG. 6D illustrating one embodiment of tack adhesive dispensed on the substrate of FIG. 6C.
Figure 10:
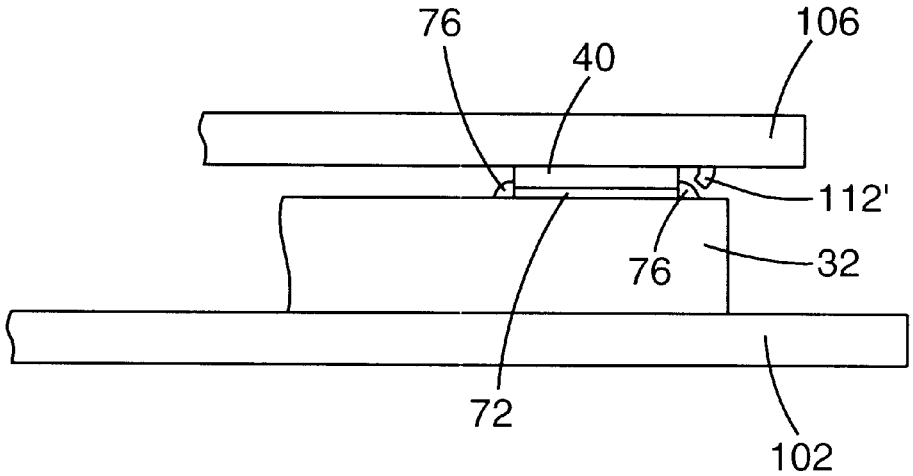
FIG. 10 is a schematic cross-sectional view similar to FIG. 6G illustrating one embodiment of tacking of the printhead dies to the substrate.

In one embodiment, as illustrated in FIGS. 9 and 10, a quantity of tack adhesive 76 is used to adhere printhead dies 40 to substrate 32 and hold printhead dies 40 in position while adhesive quantities 72 cure. In one embodiment, as illustrated in FIG. 9, tack adhesive 76 is dispensed from a dispensing unit 112 before printhead dies 40 are mounted on substrate 32. Tack adhesive 76 may be dispensed, for example, as drops which correspond to corners of printhead dies 40.

In another embodiment, as illustrated in FIG. 10, tack adhesive 76 is dispensed from a dispensing unit 112' associated with transfer arm 106. As such, tack adhesive 76 is dispensed after printhead dies 40 are positioned on substrate 32. Tack adhesive 76 may be dispensed, for example, at corners of printhead dies 40 between printhead dies 40 and substrate 32.

In one embodiment, tack adhesive 76 is a fast curing adhesive. Preferably, tack adhesive 76 is cured before adhesive quantities 72 are cured. As such, tack adhesive 76 holds printhead dies 40 in position while adhesive quantities 72 cure. Thus, movement of printhead dies 40 relative to substrate 32 is avoided. Examples of tack adhesive 76 include cyanoacrylate, Emerson & Cuming's AMICON UV307 ultraviolet light curing, surface mount adhesive, and Epoxy Technology's OG116 ultraviolet cured adhesive.

Figure 1A:
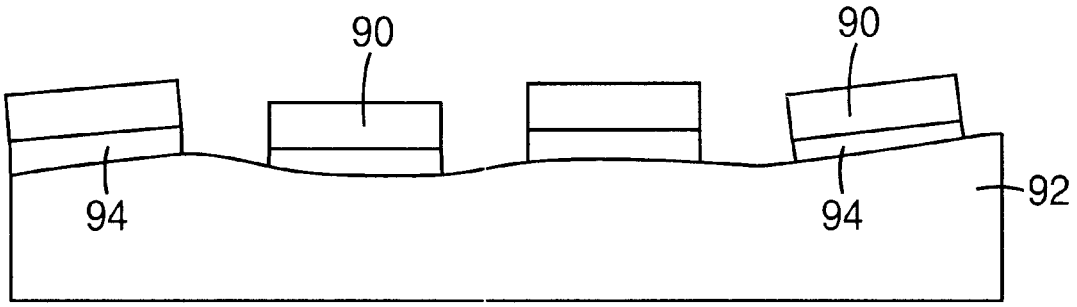
Fig. 1A PRIOR ART
FIG. 1A is a schematic cross-sectional view illustrating a plurality of printhead dies mounted on a substrate according to a prior art method.
Figure 1B:
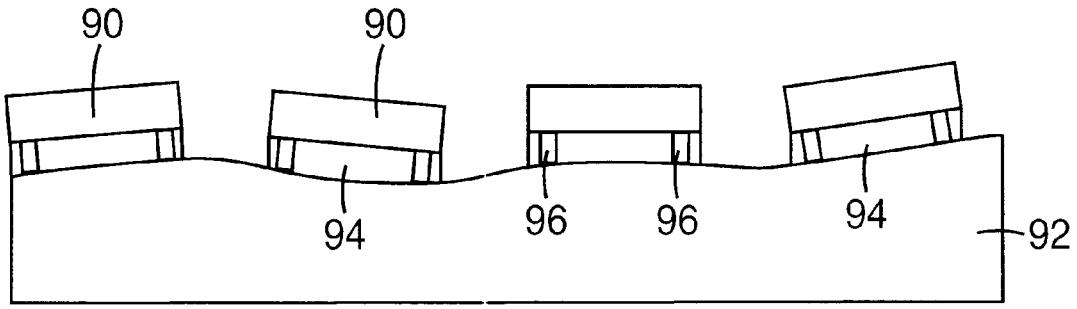
Fig. 1B PRIOR ART
FIG. 1B is a schematic cross-sectional view illustrating a plurality of printhead dies mounted on a substrate according to another prior at method.

As a non-planar surface, surface 34 of substrate 32 does not provide a desirable mounting surface for printhead dies 40. Mounting of printhead dies 40 on surface 34 using conventional mounting methods, as illustrated in FIGS. 1A and 1B, for example, would result in a variation of planarity among printhead dies 40 and, more specifically, misalignment between printhead dies 40 since printhead dies 40 would follow the profile of substrate 32. Unfortunately, a variation of planarity among printhead dies 40 can result in ink drop trajectory errors as well as pen-to-paper spacing problems which degrade print quality.

By mounting printhead dies 40 on substrate 32 with adhesive 70, however, adhesive quantities 72 compensate for the non-planarity of surface 34 and support printhead dies 40 in a substantially coplanar relationship. More specifically, since first side 741 of adhesive layers 74 conforms to surface 34 of substrate 32, the variable thickness of adhesive layers 74 compensates for the non-planarity of surface 34. As such, improved coplanarity among printhead dies 40 is facilitated since printhead dies 40 do not follow the profile of substrate 32 as with conventional mounting methods. Front faces 471 of printhead dies 40, therefore, lie in substantially one plane. In addition, by tacking printhead dies 40 to substrate 32 with tack adhesive 76, coplanarity among printhead dies 40 is maintained while adhesive 70 cures.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printhead assembly, comprising:

a substrate having a non-planar surface;

a plurality of adhesive quantities each disposed on the non-planar surface of the substrate; and a plurality of printhead dies each adhered to the non-planar surface of the substrate by one of the adhesive quantities, wherein each of the adhesives quantities have a thickness, wherein the thickness of at least one of the adhesive quantities varies from the thickness of another of the adhesive quantities to compensate for the non-planar surface of the substrate, and wherein the adhesive quantities support the printhead dies and establish a substantially coplanar relationship among the printhead dies.

2. The inkjet printhead assembly of claim 1, wherein each of the adhesive quantities form a layer of adhesive interposed between one of the printhead dies and the non-planar surface of the substrate, the layer of adhesive of at least one of the adhesive quantities having a variable thickness.

3. The inkjet printhead assembly of claim 2, wherein the layer of adhesive formed by each of the adhesive quantities has a first side and a second side opposite the first side, wherein the first side contacts the substrate and the second side contacts at least one of the printhead dies.

4. The inkjet printhead assembly of claim 3, wherein the first side of the layer of adhesive formed by the at least one of the adhesive quantities is non-planar.

5. The inkjet printhead assembly of claim 3, wherein the first side of the layer of adhesive formed by the at least one of the adhesive quantities conforms to the non-planar surface of the substrate.

6. The inkjet printhead assembly of claim 3, wherein the second side of the layer of adhesive formed by the at least one of the adhesive quantities is substantially planar.

7. The inkjet printhead assembly of claim 1, wherein each of the adhesive quantities form a continuous bead of adhesive.

8. The inkjet printhead assembly of claim 1, wherein the substrate has a plurality of ink passages extending therethrough, at least one of the ink passages communicating with the non-planar surface of the substrate and at least one of the printhead dies.

9. The inkjet printhead assembly of claim 8, wherein each of the adhesive quantities form a continuous bead of adhesive around one of the ink passages.

10. The inkjet printhead assembly of claim 1, wherein each of the printhead dies are tacked to the non-planar surface of the substrate by a tack adhesive.

11. The inkjet printhead assembly of claim 1, wherein each of the printhead dies have a front face, and wherein the front face of each of the printhead dies lies in substantially one plane.

12. The inkjet printhead assembly of claim 11, wherein each of the printhead dies has a plurality of nozzle openings defined in the front face thereof, and wherein the nozzle openings are directed substantially perpendicular to the one plane.

13. A method of forming an inkjet printhead assembly, the method comprising:

providing a substrate having a non-planar surface;

disposing a plurality of adhesive quantities on the non-planar surface of the substrate; and adhering a plurality of printhead dies to the non-planar surface of the substrate with the plurality of adhesive quantities, including supporting the printhead dies and establishing a substantially coplanar relationship among the printhead dies with the adhesive quantities, wherein each of the adhesive quantities have a thickness, and wherein the thickness of at least one of the adhesive quantities varies from the thickness of another of the adhesive quantities to compensate for the non-planar surface of the substrate.

14. The method of claim 13, wherein adhering the printhead dies to the non-planar surface includes forming a layer of adhesive between one of the printhead dies and the non-planar surface of the substrate with each of the adhesive quantities, the layer of adhesive of at least one of the adhesive quantities having a variable thickness.

15. The method of claim 14, wherein forming the layer of adhesive with each of the adhesive quantities includes conforming the layer of adhesive to the non-planar surface of the substrate.

16. The method of claim 13, wherein disposing the plurality of adhesive quantities on the non-planar surface includes forming a plurality of continuous beads of adhesive on the non-planar surface of the substrate.

17. The method of claim 13, wherein adhering the printhead dies to the non-planar surface includes positioning each of the printhead dies over one of the adhesive quantities.

18. The method of claim 17, wherein positioning each of the printhead dies includes positioning all of the printhead dies at one time.

19. The method of claim 17, wherein positioning each of the printhead dies includes lowering each of the printhead dies a predetermined distance.

20. The method of claim 17, wherein positioning each of the printhead dies includes setting each of the printhead dies at a predetermined height.

21. The method of claim 13, wherein adhering the printhead dies to the non-planar surface includes tacking each of the printhead dies to the non-planar surface of the substrate with a tack adhesive.

22. The method of claim 13, further comprising:

curing the plurality of adhesive quantities.

23. The method of claim 13, wherein the substrate has a plurality of ink passages extending therethrough, at least one of the ink passages communicating with the non-planar surface of the substrate and at least one of the printhead dies.

24. The method of claim 23, wherein disposing the plurality of adhesive quantities on the non-planar surface includes forming a continuous head of adhesive around one of the ink passages.

25. The method of claim 13, wherein each of the printhead dies has a front face, and wherein adhering the printhead dies to the non-planar surface includes aligning the front face of each of the printhead dies in substantially one plane.

26. The method of claim 25, wherein each of the printhead dies has a plurality of nozzle openings defined in the front face thereof, and wherein adhering the printhead dies to the non-planar surface includes directing the nozzle openings substantially perpendicular to the one plane.

27. A method of mounting a plurality of die modules on a non-planar surface of a substrate, the method comprising:

disposing an adhesive on the non-planar surface of the substrate;

positioning each of the die modules over the adhesive; and adhering each of the die modules to the non-planar surface of the substrate with the adhesive, including forming a layer of adhesive between the die modules and the non-planar surface of the substrate, and supporting the die modules and establishing a substantially coplanar relationship among the die modules with the adhesive, wherein the layer of adhesive has a variable thickness to compensate for the non-planar surface of the substrate.

28. The method of claim 27, wherein forming the layer of adhesive includes conforming the layer of adhesive to the non-planar surface of the substrate.

29. The method of claim 27, wherein disposing the adhesive on the non-planar surface includes forming a plurality of continuous beads of adhesive on the non-planar surface of the substrate.

30. The method of claim 27, wherein positioning each of the die modules includes positioning all of the die modules at one time.

31. The method of claim 27, wherein positioning each of the die modules includes lowering each of the die modules a predetermined distance.

32. The method of claim 27, wherein positioning each of the die modules includes setting each of the die modules at a predetermined height.

33. The method of claim 27, wherein adhering each of the die modules to the non-planar surface includes tacking each of the die modules to the non-planar surface of the substrate with a tack adhesive.

34. The method of claim 27, further comprising:

curing the adhesive.

35. The method of claim 27, wherein the die modules include inkjet printhead dies.

* * * * *

UNITED STATES PATENT AND TRADEMARK OFFICE

CERTIFICATE OF CORRECTION

PATENT NO. : 6,409,307 B1
DATED : June 25, 2002
INVENTOR(S) : Akhavain et al.

It is certified that error appears in the above-identified patent and that said Letters Patent is hereby corrected as shown below:

Title page, Item [54] and Column 1, lines 1-3,
The title, "COPLANAR MOUNTING OF PRINTHEAD DIES FOR WIDE-ARRAY INKJET PRINTHEAD ASSEMBLY" should read -- COPLANAR MOUNTING OF PRINTHEAD DIES FOR INKJET PRINTHEAD ASSEMBLY --;

Column 11,
Line 3, "head" should read -- bead --.

Signed and Sealed this

Twenty-second Day of July, 2003

JAMES E. ROGAN
*Director of the United States Patent and Trademark Office*